US006642467B2

(12) United States Patent
Farringdon

(10) Patent No.: US 6,642,467 B2
(45) Date of Patent: Nov. 4, 2003

(54) ELECTRICAL SWITCH FOR USE IN GARMENTS

(75) Inventor: Jonathan Farringdon, Penshurst (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 6 days.

(21) Appl. No.: 09/902,840

(22) Filed: Jul. 11, 2001

(65) Prior Publication Data

US 2002/0005342 A1 Jan. 17, 2002

(30) Foreign Application Priority Data

Jul. 13, 2000 (GB) ..... 0017191

(51) Int. Cl.[7] ..... H01H 1/14

(52) U.S. Cl. ..... 200/511; 2/905; 200/508; 200/512

(58) Field of Search ..... 200/508, 511, 200/512, DIG. 2; 2/905, 1

(56) References Cited

U.S. PATENT DOCUMENTS 1,488,085 A * 3/1924 Zachara ..... 2/69
2,106,658 A * 1/1938 Rakps ..... 200/DIG. 2
2,962,580 A * 11/1960 Jones ..... 2/69
3,383,487 A * 5/1968 Wiener ..... 200/512
4,295,699 A * 10/1981 DuRocher ..... 200/511
4,315,111 A * 2/1982 Thomas ..... 200/DIG. 2

* cited by examiner

*Primary Examiner*—Renee Luebke

(57) ABSTRACT

A switch suitable for use in garments is provided. The switch comprises an arrangement of at least two electrically conductive contact portions provided in the form of textile fastener components. The textile fastener components may be stud fastener components mounted on fabric portions and normally separated by resilient biasing means such as compressible foam material. The application of a sufficient force causes the compressible foam material to yield allowing the textile fastener components to contact each other physically and therefore electrically. Removal of the applied force allows the foam material to return to its shape prior to yielding and therefore separate stud fastener components. The switch utilizes components often found in clothing allowing the switch to be incorporated into garments using machinery and workforce skills widespread within the garment manufacturing industry. The fastener components may be replaced with eyelets and a cord arranged to pass through the eyelet through-holes may be pulled to operate the switch.

13 Claims, 9 Drawing Sheets

ELECTRICAL SWITCH FOR USE IN GARMENTS

The present invention relates to an electrical switch suitable for use in garments.

The task of integrating or fitting electrical and electronic apparatus within clothing presents a number of problems to the designer, including the incorporation of switches.

An approach to integrating electrical switches into clothing is to use standard "off the shelf" electronic components which are then sewn, glued or otherwise mounted to clothing. Unfortunately this approach has a number of disadvantages arising from the fact that these components are primarily intended for use in conventional electronic equipment. In such conventional equipment these switches are easily accommodated by mounting them on a printed circuit board or other part of the equipment. However, in the case of clothing which is normally manufactured from flexible textile material, even if the switches are successfully attached, the mounting achieved will not always be rigid making operation of the switch difficult, especially one-handed operation. Taking the example of a known simple toggle switch, the base part of the switch needs to be held firmly while the lever part is operated. While the unsatisfactory physical mounting of the switch causes problems with switch operation, another drawback is that clothing provided with these components has the feel and appearance of clothing with components stuck on top, rather than the components being neatly integrated and in keeping with the character of the clothing.

This latter point is important because a primary consideration when selecting a garment is its appearance. The inclusion of a switch that detracts from the appeal of clothing is most undesirable from the point of view of the designer and consumer. Switches for use in clothing that are to be visible should look right, whether they are incorporated as a prominent design feature, as a discrete implementation or even disguised.

The use of such conventional components also causes problems to garment manufacturers because the machines and processes commonly used within the garment construction industry will not be designed for connecting the switches to fabrics, either in terms of providing a physical mounting for the switches or making the electrical connectors thereto.

It is an object of the present invention to provide an electrical switch which may be integrated into clothing. It is another object of the present invention to provide an electrical switch which may be integrated with clothing at a stage of garment manufacture using machinery that is commonplace within the garment construction industry.

In accordance with a first aspect of the present invention there is provided a switch for use in garments, said switch comprising an arrangement of at least two electrically conductive contact portions arranged in proximity to each other, each contact portion being provided in the form of a textile fastener component mounted on a fabric portion; and resilient spacing means acting to bias the contact portions away from each other such that the contact portions ordinarily reside in a spaced apart relationship, wherein the switch is operable by the application of force directed against the action of said spacing means to move said contact portions towards one another to establish electrical connection there between.

Advantageously, the use of textile fasteners which are commonplace in the garment construction industry means that the fasteners, together with the machinery and processes, for fitting the fasteners to garments are readily available to garment manufacturers. A workforce skilled in attaching the fasteners will also be available therefore reducing the overall cost of including the switch of the present invention into garments and the extent to which the workforce needs to be trained in fitting the switches. Furthermore, the consumer is accustomed to seeing such fasteners in clothing and therefore the visible incorporation of this switch into garments will be generally more acceptable to the consumer than would be the incorporation of a conventional electrical switch component. The switch should provide easy user operation. Ideally, the switch may also facilitate easy one handed operation.

The electrical connection may be provided as a result of direct physical contact of the contact portions.

Alternatively the switch may further comprise a pressure sensitive component arranged in physical and electrical contact with each contact portion, which component undergoes a change in electrical characteristic as a function of force applied to it, wherein said established electrical connection between the contact portions is provided by the pressure sensitive component while the pressure sensitive component is subjected to the applied force.

When each textile fastener component is an eyelet, the switch may be arranged to permit a pull cord to pass through each eyelet centre to continue from a first side of the switch through to a second side of the switch, and an abutment arrangement on one of the first or second side of the switch for acting on the one adjacent eyelet and being actuable by the pull cord such that when the pull cord is operated by a pulling action the abutment urges the said one adjacent eyelet in the direction of the other to establish the electrical connection.

These and other aspects of the present invention will now be described, by way of example only, with reference to the Figures of the accompanying drawings in which:

FIG. 1*a* shows a cross sectional view of a type of textile fastener components attached to fabric;

FIG. 1*b* shows a simplified representation of the fastener components of FIG. 1*a;*

FIG. 2*a* shows a cross sectional view of another type of textile fastener components attached to a fabric;

FIG. 2*b* shows a simplified representation of the fastener components of FIG. 2*a;*

FIG. 3*a* shows a cross sectional view of a first arrangement of a switch made in accordance with the present invention with the switch in an open position;

FIG. 3*b* shows a cross sectional view of the switch of FIG. 3*a* but with the switch in a closed position;

FIG. 3*c* shows a cross sectional view of an embodiment of the switch of FIG. 3*a* incorporating protruding spike portions;

FIG. 4*a* shows a cross sectional view of a second arrangement of a switch made in accordance with the present invention with the switch in an open position;

FIG. 4*b* shows a cross sectional view of the switch of FIG. 4*a* but with the switch in a closed position;

Figure 1A:
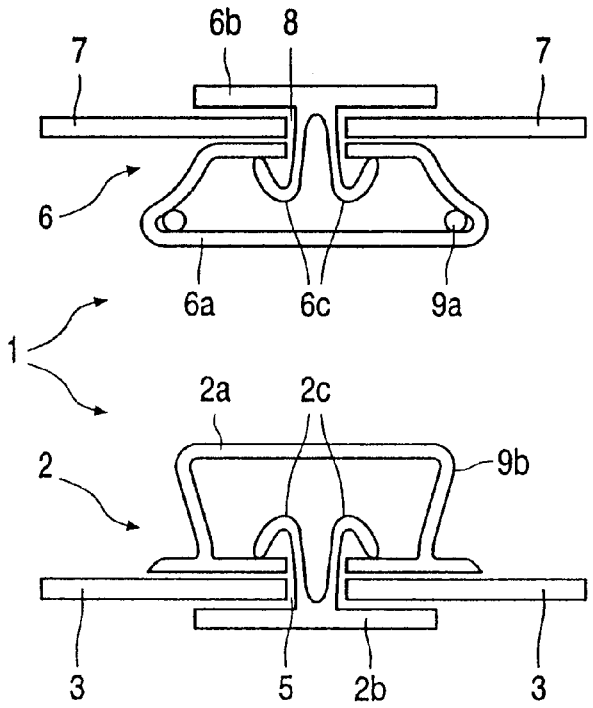

It should be noted that drawings are diagrammatic and not drawn to scale. Relative dimensions and proportions of parts may have been shown in exaggerated or reduced form in the Figures for the sake of clarity. Where appropriate, the same reference numerals are generally used to refer to corresponding or similar features in the different examples described and illustrated herein.

Referring to FIG. 1*a*, a textile fastener of the press fastener type 1 is shown. Press fasteners are commonly included in garments and other textile products such as clothing accessories and soft furnishings. Press fasteners are also referred to as press-studs, snap fasteners and pop fasteners. One side of the fastener is provided as a stud 2 comprising a stud part 2*a* which is shown attached to a fabric portion 3 using post 2*b*. Post 2*b* extends from one side of the fabric portion 3 through a hole 5 in the fabric to an other side of the fabric, where it engages with the stud part 2*a* by means of deformed post portions 2*c*. The hole 5 may be formed prior to attachment of the stud 2. Alternatively the hole 5 may be formed by the stud part 2*a* and/or post 2*b* during attachment of the stud 2 to the fabric portion 3 in a self piercing operation caused by the stud. Thus stud part 2*a* and post 2*b* are attached to the fabric portion 3 as will be well understood by the person skilled in the art.

The other side of the fastener is provided as a socket 6 comprising a socket part 6*a* which is shown attached to a fabric portion 7 using a cap 6*b*.

Cap 6*b* has a portion which extends from one side of the fabric portion 7, through a hole 8 in the fabric to an other side of the fabric, where it engages with the socket part 6*a* by means of deformed cap portions 6*c*. The hole 8 may be formed prior to attachment of the socket 6. Alternatively the hole 8 may be formed by the socket part 6*a* and/or cap 6*b* during attachment of the socket to the fabric portion 7 in a self piercing operation caused by the socket. Thus the socket part 6*a* and cap 6*b* are attached to the fabric portion 7 as will be well understood by the person skilled in the art.

The press fastener 1 is formed such that the stud part 2*a* can be inserted into the socket part 6*a* where it will be realisably held because spring component 9*a* of the socket part 6*a* engages with lip portions 9*b* of the stud part 2*a,* as is well understood by the person skilled in the art. Hence, fabric portions 3 and 7 may be realisably held together by the press fastener 1.

The attachment of this type of fastener component to fabric is well known to the skilled person, as are variations in such attachment detail.

Figure 1B:
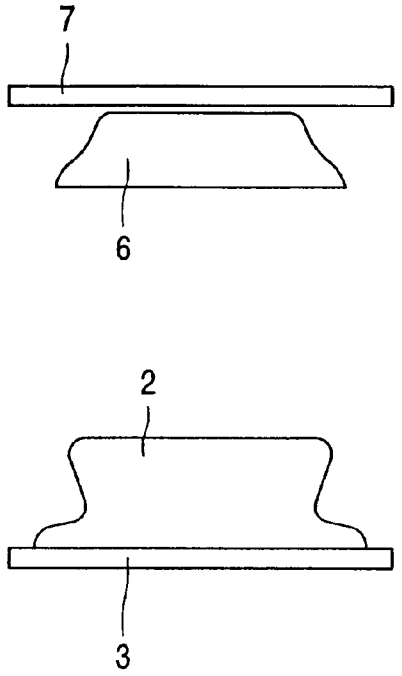

Therefore, in the interest of clarity, where these particular fastener components appear in subsequent Figures, the placement of these fastener components will be shown as in FIG. 1*b* and detail of how the fastener components are attached will be omitted. As an exception, details of attachment will be given where it would not be immediately apparent to the person skilled in the art how such components are fixed, or where the particular fixing technique employed is critical to the correct operation of the present invention.

Hence FIG. 1*b* shows fabric portion 3 of FIG. 1*a* and stud 2*a* of FIG. 1*a* denoted here as stud 2. The Figure omits to show post 2*b*, deformed post portions 2*c* and fabric hole 5 for the sake of clarity. Similarly, FIG. 1*b* shows fabric portion 7 of FIG. 1*a* and socket part 6*a* of FIG. 1*a* denoted here as socket 6. The Figure omits to show cap 6*b,* deformed cap portions 6*c* and fabric hole 8 for the sake of clarity.

Figure 2A:
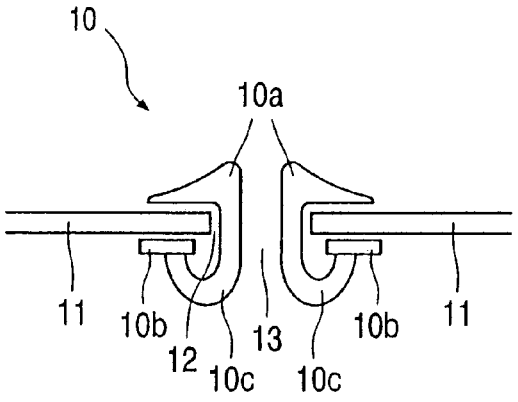

Referring to FIG. 2*a* a textile fastener of the eyelet type 10 is shown attached to a fabric portion 11. Here the eyelet fastener is formed of a main eyelet part 10*a* which extends from a first side to a second side of the fabric portion 11 through a hole 12 in the fabric portion. On the second side of the fabric portion 11 the main eyelet part 10*a* engages with a washer 10*b* by means of deformed eyelet portions 10*c*. The washer 10*b* is an optional component and where it is omitted, the deformed eyelet portions 10*c* may bear directly against the second side of the fabric 11. The main eyelet part 10*a* has a central through-hole 13. The fabric hole 12 may be formed prior to attachment of the eyelet 10. Alternatively the fabric hole 12 may be formed by the main eyelet part 10*a* during attachment of the eyelet 10 to the fabric portion 11 in a self piercing operation caused by the eyelet part. Thus the eyelet 10 is attached to the fabric portion 11 as will be well understood by the person skilled in the art.

The attachment of this type of fastener component to fabric is well known to the skilled person, as are variations in such attachment detail. Therefore, in the interest of clarity, where these particular fastener components appear in subsequent Figures, the placement of these fastener components will be shown as in FIG. 2*b* and detail of how the fastener components are attached will be omitted. As an exception, details of attachment will be given where it would not be immediately apparent to the person skilled in the art how such components are fixed, or where the particular fixing technique employed is critical to the correct operation of the present invention.

Figure 2B:
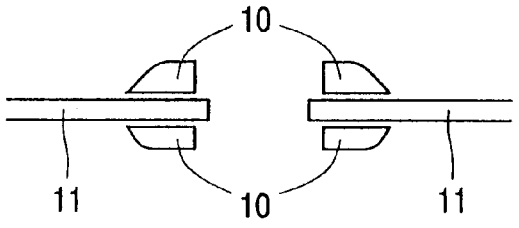

Hence FIG. 2*b* shows fabric portion 11 of FIG. 2*a*. The main eyelet part, washer 10*b* and deformed eyelet portions 10*c* are all denoted as eyelet 10.

Figure 3A:
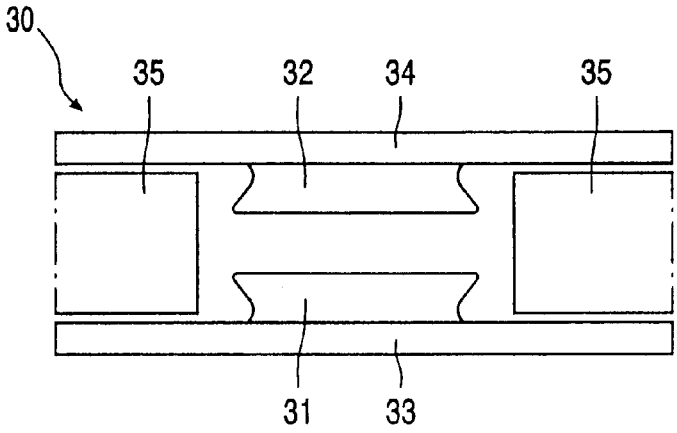

Referring to FIG. 3*a*, switch 30 comprises a first contact in the form of first fastener stud part 31 and a second contact in the form of second fastener stud part 32. The stud parts 31 and 32 are generally cylindrical or disc-like in shape.

The first stud part 31 is attached to a first fabric portion 33 and the second stud part 32 is connected to a second fabric portion 34. In the figure, each stud part is shown as a solid component for purposes of clarity, although each stud part may be an assembly of two or more discrete parts. Resilient spacing means is provided in the form of a spacing component 35 which is interposed between the first and second fabric portions 33, 34 to keep the fabric portions spaced apart from each other. Because the first stud part 31 is attached to first fabric portion 33 and the second stud part 32 is attached to the second fabric portion 34, the spacing component 35 also serves to maintain the first and second stud part in spaced apart relation with respect to each other. Since each stud part forms a contact of the switch, while the first and second stud parts are spaced apart from each other the switch is in the electrically open (non-conductive) position.

Figure 3B:
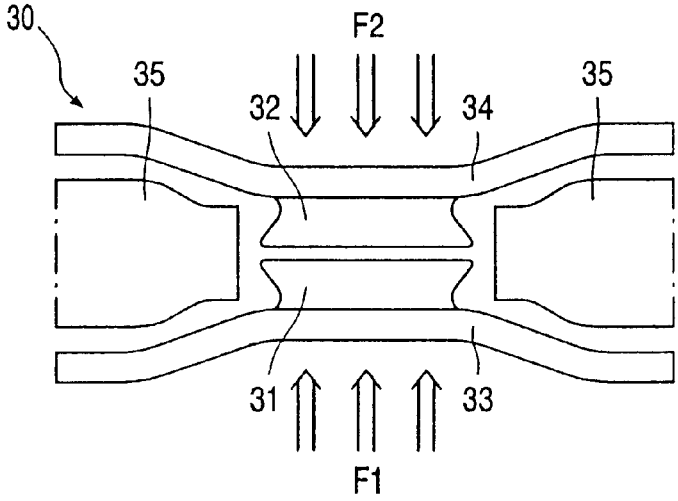

The spacing component 35 is resiliently deformable under the application of force, as will be seen in FIG. 3*b* which shows the same switch arrangement of FIG. 1 but in a second position. Here a force F1 is applied to the first stud part 31 in the position and direction indicated, while a force F2 is applied to the second stud part 32 in the position and direction indicated, which is a direction opposite to that of force F1. As a result the two stud parts 31 and 32 are each moved in a direction such that they are urged towards each other. By applying a sufficient force F1 and F2 the resiliently deformable spacing component 35 yields to allow the stud parts 31 and 32 to move towards each other and subsequently make direct physical contact. Each stud part is electrically conductive such that when the switch is in the second position with the stud parts in physical contact, the stud parts are also in electrical contact and the switch is in the electrically closed (conductive) position. On removal of the force F1 and F2 the resiliently deformable spacing means 35 separates the stud parts 31 and 32 to return the switch to the electrically open position as previously illustrated in FIG. 3*a*.

Figure 4A:
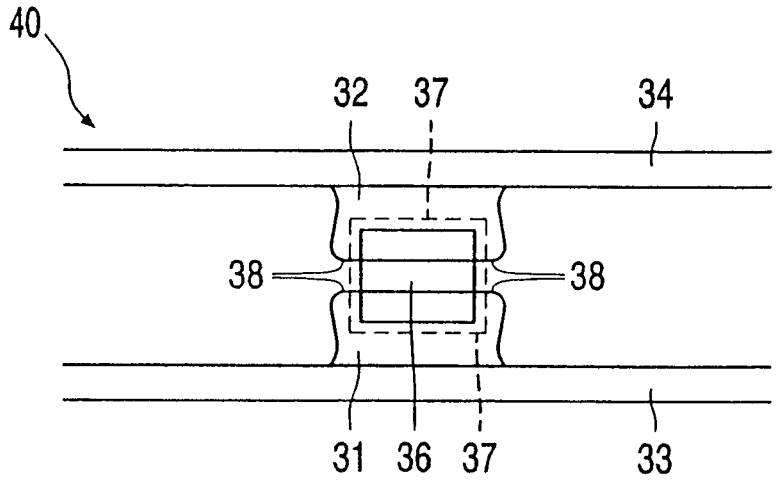
Figure 4B:
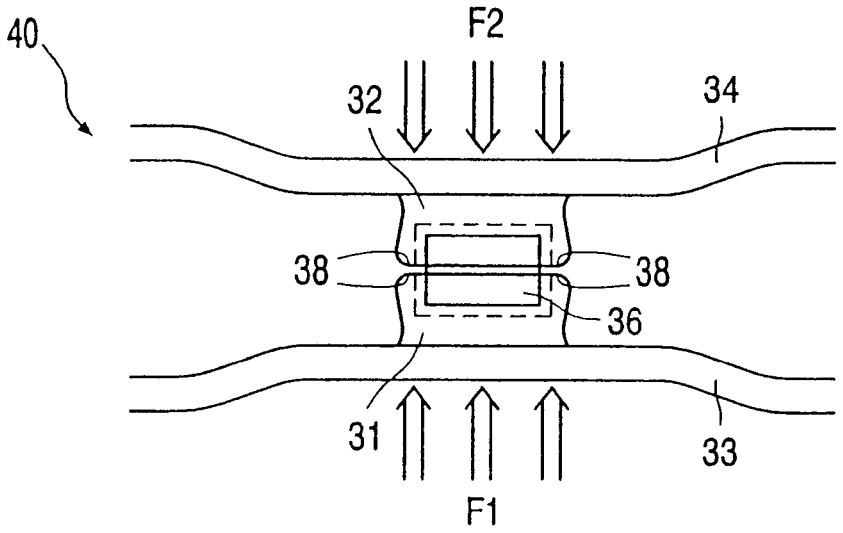

FIG. 4*a* shows a switch 40 which is a variation of the switch shown in FIGS. 3*a* and 3*b* but incorporating the provision of resilient spacing component 36 interposed between at least part of the first and second stud parts 31, 32. The resilient spacing component 36 may be provided in addition to or as an alternative to resilient spacing component 35 of switch 30. Components in common with those of switch 30 are shown and denoted with the same reference numerals as used in FIGS. 3*a* and 3*b*. The stud parts 31, 32 are generally cylindrical in shape and are provided with cup-like recesses 37 allowing the resilient spacing component 36 to be at least partially accommodated therein. The resilient spacing component is also generally cylindrical in shape. The presence of the recesses 37 in each stud serves to partially define protruding stud rim portions 38. Referring to FIG. 4*b*, application of sufficient force F1 and F2 to first and second stud parts 31, 32 respectively causes the resiliently deformable spacing component 36 to yield allowing the two stud parts 31 and 32 to move in a direction towards each other until their respective rim portions 38 abut with each other. Since each stud part is electrically conductive, the direct physical contact of first and second stud parts 31 and 32 causes the switch to be in an electrically conductive (closed) position, as with the switch 30. On removal of the force F1 and F2 the resiliently deformable spacing means 36 separates the stud parts 31 and 32 to return the switch to the electrically open position as previously illustrated in FIG. 4*a*. The resiliently deformable spacing component 36 is electrically insulating.

The switch arrangement shown in FIGS. 4*a* and 4*b* may be modified by substituting the insulating resiliently deformable spacing component 36 with a pressure sensitive component which changes one or more of its electrical characteristics as a function of force applied to it or as a function of the resulting deformation. Electrical characteristics that could be so changed include resistance, capacitance and inductance. Because the pressure sensitive component resides in recesses 37 of stud parts 31, 32, the application of force F1 and F2 is communicated by the stud parts 31, 32 to the pressure sensitive component. Taking the example of a pressure sensitive component that exhibits a reduction in electrical resistance as the force applied to it increases, the presence of force F1 and F2 as shown in the Figures will cause the component to exhibit a lower electrical resistance than when the force F1 and F2 is not applied. Because the pressure sensitive component is in electrical connection with stud parts 31 and 32, the electrical resistance measured between the studs 31, 32 will be low during the application of force F1 and F2 in comparison to the measured electrical resistance when the force is not so applied. Therefore the lower electrical resistance may be deemed the resistance of the switch when in the electrically closed (conductive) position and the higher electrical resistance may be deemed the resistance of the switch when in the electrically open (nonconductive) position. The characteristics of the material may be tailored to obtain the required electrical characteristics of the switch and the output of the switch may be conditioned and/or interpreted using signal processing apparatus. Furthermore, the measured resistance between studs 31, 32 can be used to determine the magnitude of the force F1 and F2 applied to the switch, either in relative or absolute terms, allowing the switch to be used as a sensor. Indeed, different measured output resistances could be interpreted by equipment to cause the performance of different functions. One example of this would be where a switch of this type is incorporated in a garment and used to control an audio reproduction device. Moderate application of force to the switch could cause the audio programme to advance by one period, say 5 seconds, whereas application of a greater force could cause the audio programme to advance by another period, say 20 seconds, or even to the following audio track.

Where the pressure sensitive component is provided it may be desirable to vary the dimensions of the component to achieve the required switch travel and output characteristics. In some circumstances it will also be preferred to coat the stud rim portions 38 with an insulator so that when the switch is fully closed, as shown in FIG. 4*b*, the only electrical contact between the stud parts 31, 32 is by means of the pressure sensitive component. As with the switch 30, the pressure sensitive component may be provided instead of or in addition to the spacing component 35; that is the pressure sensitive component may or may not play a part in serving to separate stud parts 31, 32.

Example materials for producing the pressure sensitive component include fabrics, polymer material, rubberised materials, plasticised materials and foam based materials. Indeed these materials may be treated to control their electrical characteristics, one way being to introduce a carbon material. Other pressure sensitive devices, such as a piezo-electric transducer could be employed. Materials or devices could be used such that they respond to compression and tensioning.

Figure 5:
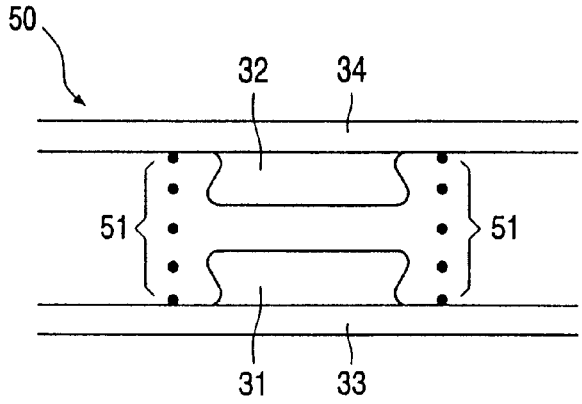
FIG. 5 shows a cross sectional view of a third arrangement of a switch made in accordance with the present invention with the switch in an open position.
Figure 6:
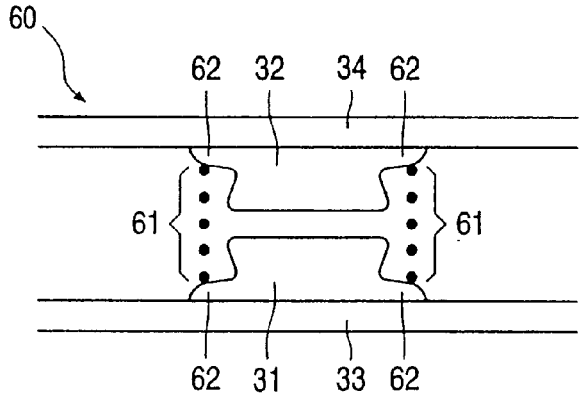
FIG. 6 shows a cross sectional view of a fourth arrangement of a switch made in accordance with the present invention with the switch in an open position.
Figure 7:
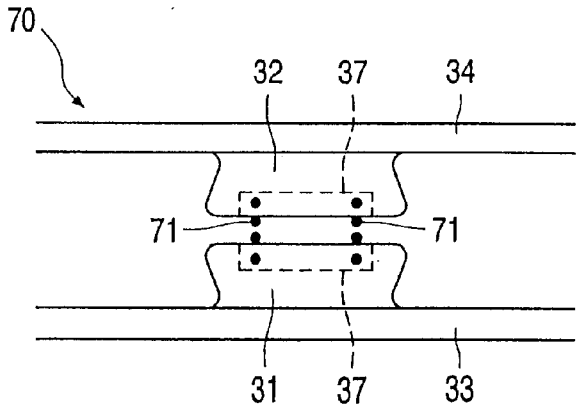
FIG. 7 shows a cross sectional view of a fifth arrangement of a switch made in accordance with the present invention with the switch in an open position.
Figure 8:
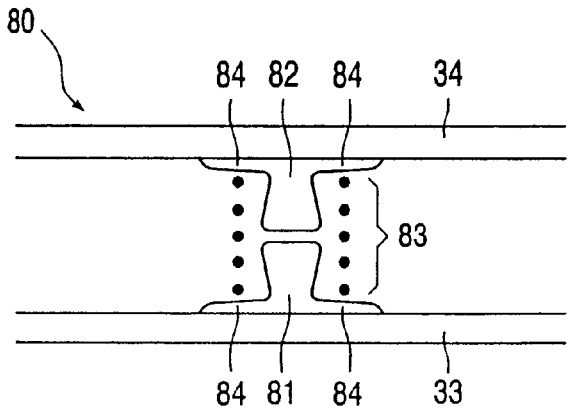
FIG. 8 shows a cross sectional view of a sixth arrangement of a switch made in accordance with the present invention with the switch in an open position.

Referring to FIG. 5, switch 50 is similar to switches 30 and 40 but is provided with a resilient spacing component in the form of coil spring 51 acting on fabric portions 33 and 34 respectively to bias the fabric portions and hence the attached stud parts 31, 32 away from each other. Resilient spacing component 51 may be provided instead of or in addition to the spacing means 35 or 36 of switches 30 and 40. A variation of the arrangement of switch 50 is shown in FIG. 6 where switch 60 is again provided with a resilient spacing component in the form of a coil spring 61, but here the coil spring is arranged to act directly on shoulder portions 62 of the stud parts 31 and 32. In this case it is important that the coil spring 61 is electrically insulating or coated with a material that is electrically insulating to avoid providing an electrical short between stud parts 31, 32 while the switch is in an electrically open position. Alternatively the coil spring could be insulated from the stud parts by an interposed electrically insulating component. A further variation is shown in FIG. 7 illustrating switch 70 which is essentially the same as switch 40 of FIGS. 4*a* and 4*b*, but with the resilient spacing component 36 replaced by coil spring 71 provided in the cup-like recesses 37 of the stud parts 31, 32. Once again, it is important that the coil spring 71 is electrically insulating or coated with a material that is electrically insulating to avoid providing an electrical short between stud parts 31, 32 while the switch is in an electrically open position. FIG. 8 shows switch 80 which is yet a further variation on the arrangement of FIG. 5 where the stud parts 31, 32 are substituted with stud parts 81, 82 respectively of a type having a comparatively narrow but bulbous profile. Here the resilient spacing component is provided by coil spring 83 acting on stud shoulder portions 84, and the coil spring sits around the bulbous regions of the studs parts 81, 82. Again, the coil spring 83 is electrically insulating or coated with a material that is electrically insulating to avoid providing an electrical short between stud parts 81, 82 while the switch is in an electrically open position.

Figure 9:
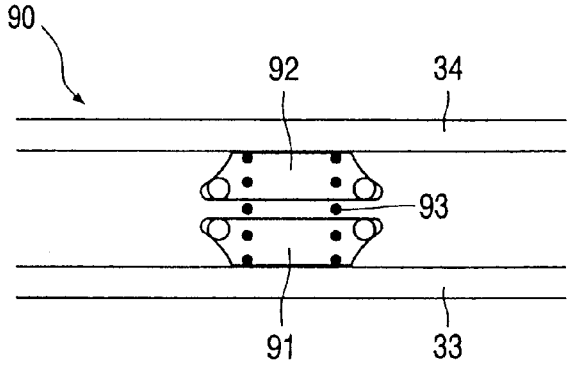
FIG. 9 shows a cross sectional view of a seventh arrangement of a switch made in accordance with the present invention with the switch in an open position.
Figure 10:
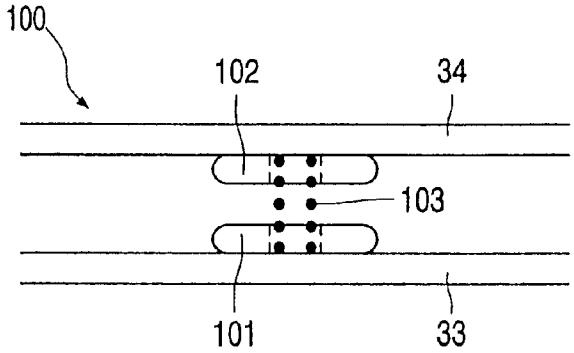
FIG. 10 shows a cross sectional view of a eighth arrangement of a switch made in accordance with the present invention with the switch in an open position.

FIG. 9 shows switch 90 using press fastener socket parts 91, 92 attached to fabric portions 33, 34 respectively. The socket parts 91, 92 are normally separated by resilient spacing means in the form of coil spring 93. However, switch 90 is similar in principle to the previously described switching arrangements and differs only through the use of fastener socket parts instead of fastener stud parts and accordingly variations may be made to switch 90 to arrive at similar arrangements to those already described, as will be appreciated by the person skilled in the art. FIG. 10 shows switch 100 which is similar to switch 90 but employs fastener socket parts 101, 102 of a different design. A coil spring 103 is shown.

The resilient biasing means may be of any suitable design and material or materials which will serve to separate the contact portions after the removal of force F1, F2. As such, the spacing component (resilient biasing means) may be a spring, for example a coil spring, foam rubber, rubber, plastics material, gel or other suitable material, as will be appreciated by the person skilled in the art.

Figure 11:
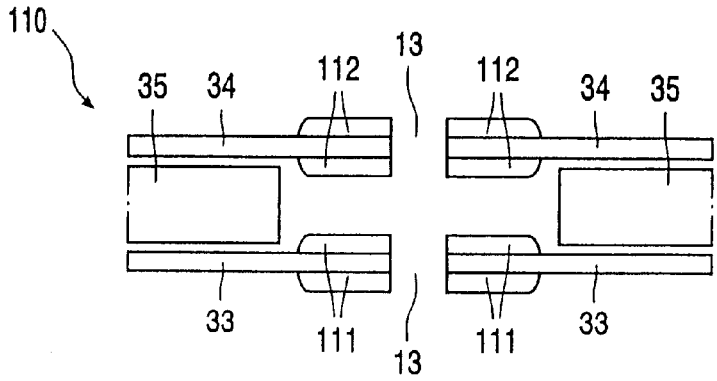
FIG. 11 shows a cross sectional view of a ninth arrangement of a switch made in accordance with the present invention with the switch in an open position.
Figure 12:
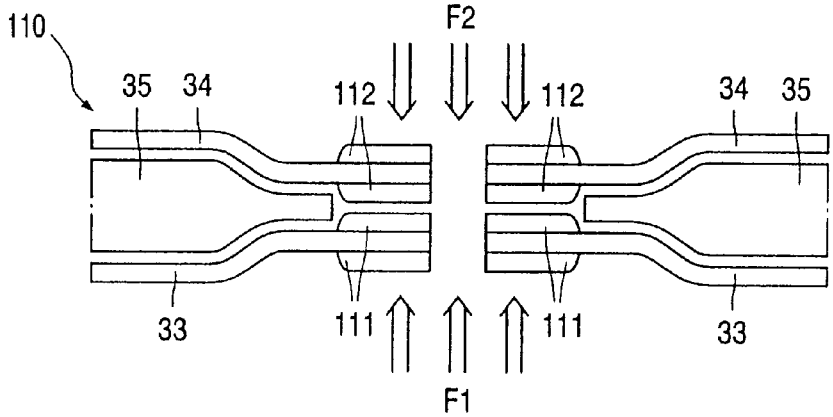
FIG. 12 shows a cross sectional view of the switch of FIG. 11 but with the switch in a closed position.

FIG. 11 shows switch 110 which is a modification of the previously described switches but employing eyelets 111, 112 (instead of stud or socket parts) attached to fabric portions 33, 34 respectively. Each eyelet defines an eyelet through-hole 13. Spacing component 35 is also shown but any other suitable spacing component previously described or a variation thereof may be employed, as will be appreciated by the person skilled in the art. Switch 110 is shown in FIG. 12 but in an electrically closed position by virtue of the conductive eyelets being in physical contact with each other. The switch could include a pressure sensitive component of the type already described, as will be appreciated by the person skilled in the art.

Figure 13:
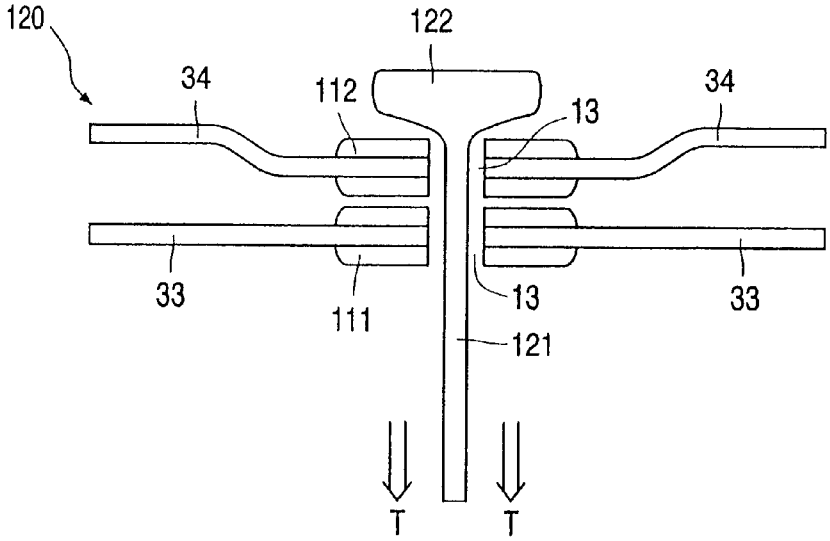
FIG. 13 shows a cross sectional view of a tenth arrangement of a switch made in accordance with the present invention, the switch shown in a closed position and being provided with a cord pull.

FIG. 13 shows switch 120, which is a variant of switch 110 through the inclusion of a pull cord 121. The resilient spacing component 35 is not shown in the interest of clarity. The pull cord 121 is arranged to pass through each eyelet through-hole 13 from a first side of the switch to a second side of the switch. On the second side of the switch an enlarged portion 122 of the cord 121 is provided with a cross section larger then the eyelet through-hole 13 such that the enlarged portion 122 abuts a face of eyelet ring 112 (that is on the side remote from the eyelet ring 111) to prevent the cord 121 moving in the direction T relative to the eyelet 112. Hence the application of a pulling force to cord 121 in direction T will transfer such force to eyelet 112 and thus also urge it in the direction T. By providing the first fabric portion 33 and/or the eyelet 111 with restraining means (not shown) to impede the movement thereof, the application of sufficient force to cord 121 in the direction T causes the spacing means 35 to yield and the eyelets 112, 111 will be brought together into physical contact and cause the switch to adopt an electrically closed position. The electrically closed position is the one illustrated in FIG. 13. Hence a switch is provided which is operable by pulling a cord. While the cord is described as having an enlarged portion 122, this may be provided simply by tying a knot in the cord. A further alternative includes the provision of a separate component or components to transfer the torsional force T from cord 121 to eyelet 112, as will be appreciated by the person skilled in the art. A suitable example would include a clamping arrangement. The spacing component 35 may be substituted or supplemented by any other suitable spacing means. The restraining means employed to impede the movement of the fabric portion 33 and/or the eyelet 111 does not necessarily need to be comprised of one or more separate components. The restraining means may be realised merely by providing the fabric portion 33 as a relatively rigid component through treatment or reinforcement of the fabric material 33 or substitution with a more rigid material.

Figure 14:
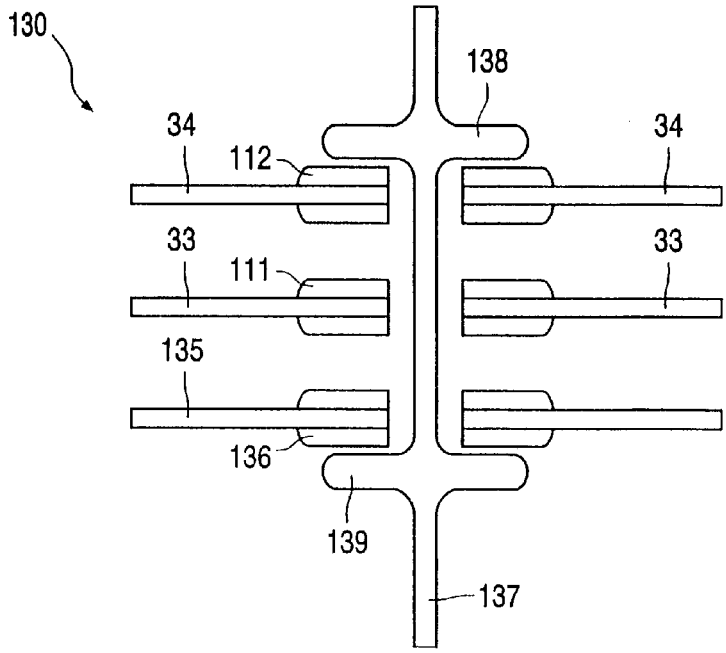
FIG. 14 shows a cross sectional view of an eleventh arrangement of a switch made in accordance with the present invention, the switch allowing two-way switching operation and shown in an open position.

The switches 110 and 120 are one way switches. FIG. 14 shows a development of these switches in the form of switch 130 which provides a two-way switching operation. Switch 130 takes switch 110 (or 120) and adds further fabric portion 135 with further eyelet 136 attached thereto and in-line with eyelets 111, 112. Fabric portion 33 and eyelet 111 are situated between fabric portion 34, 135 and eyelets 112, 136 respectively. Resilient spacing means (not shown) of the type already discussed herein is provided to separate fabric portion 33/eyelet 111 from fabric portion 135/eyelet 136. Cord 137 is similar to cord 121 but enlarged portion 122 is replaced by enlarged portion 138 which does not represent the termination of the cord, which cord continues beyond the enlarged portion 138. The cord is also provided with further enlarged portion 139 which abuts a face of the eyelet ring 136 (that is on a side remote from the eyelet 111). The pull cord 137 is arranged to pass through each eyelet through-hole 13 from a first side of the switch to a second side of the switch.

Figure 15:
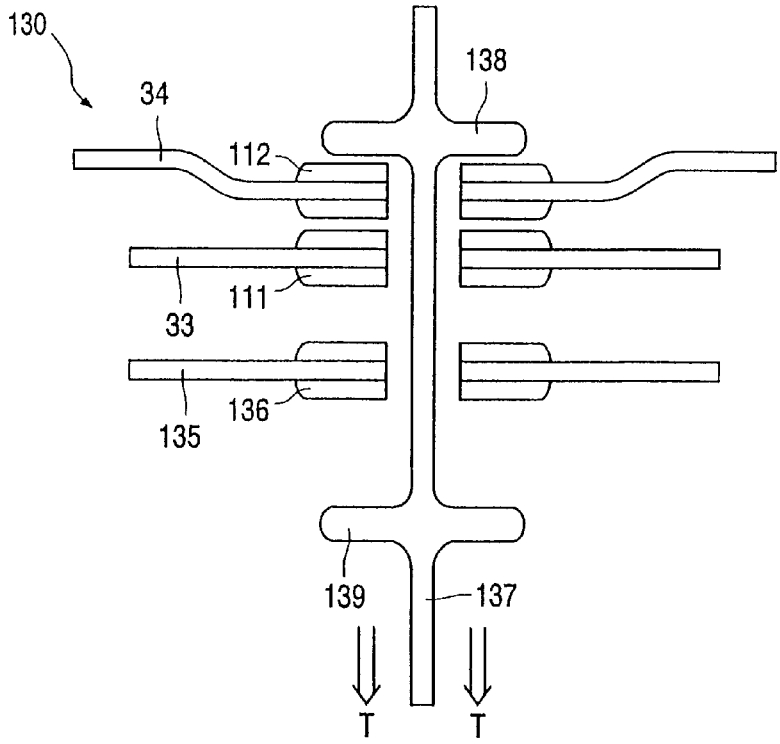
FIG. 15 shows a cross sectional view of the switch of FIG. 14 but in a first closed position.

When the cord 137 of switch 130 is pulled in the direction T, enlarged portion 138 bears on eyelet 112 such that it is also urged in the direction T until it contacts eyelet 111. This is illustrated in FIG. 15 and hence the first switch contact (in the form of eyelet 111) is brought into physical and therefore electrical contact with the second switch contact (in the form of eyelet 112). On removal of the tension T, the resilient spacing means (not shown) returns the switch to the electrically open position, as shown previously in FIG. 14.

Figure 16:
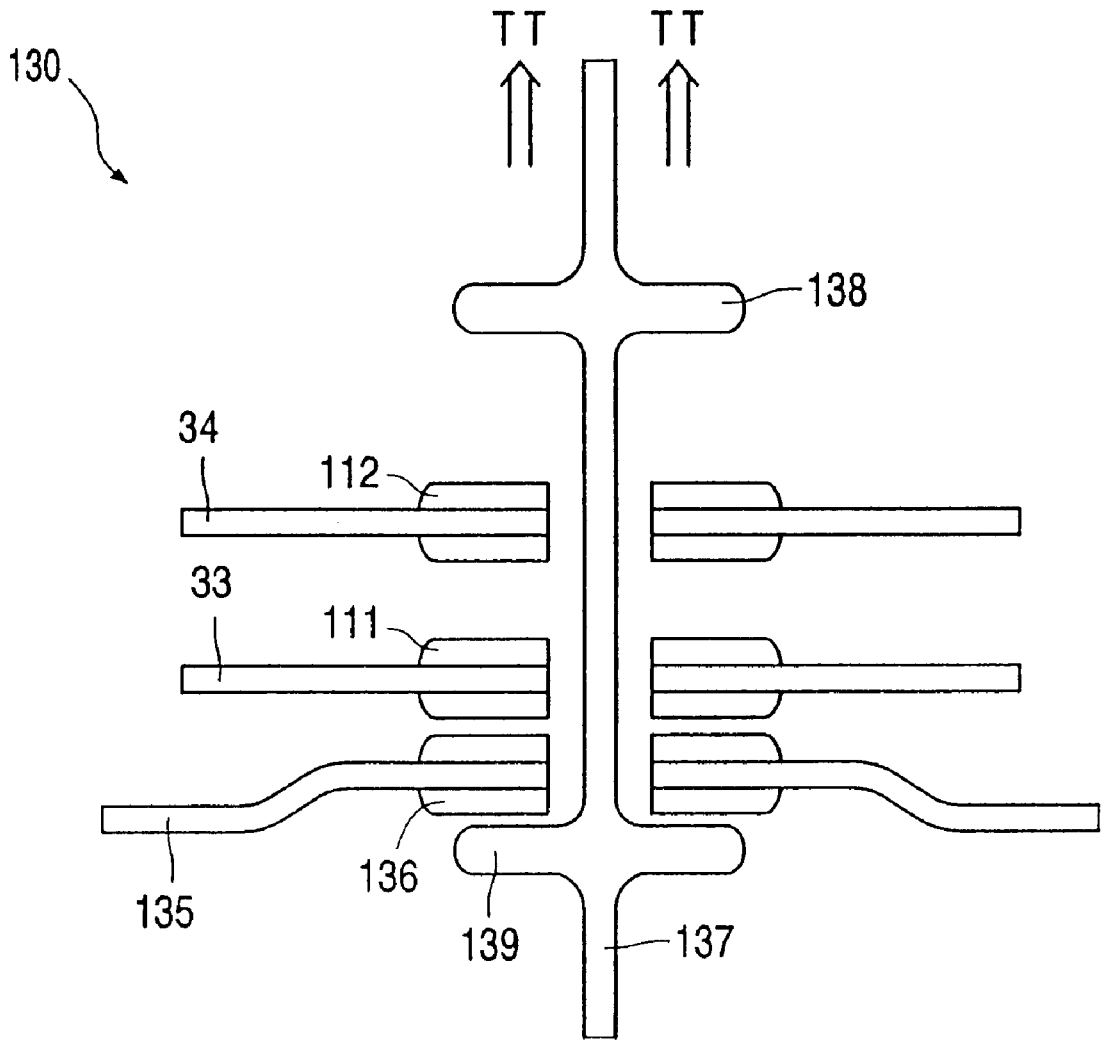
FIG. 16 shows a cross sectional view of the switch of FIG. 14 but in a second closed position.

Referring to FIG. 16, when the cord 137 of switch 130 is pulled in the direction TT, enlarged portion 139 bears on eyelet 136 such that it is also urged in the direction TT until it contacts eyelet 111. This is illustrated in FIG. 16 and hence the first switch contact (in the form of eyelet 111) is brought into physical and therefore electrical contact with the third switch contact (in the form of eyelet 136). On removal of the tension TT, the resilient spacing means (not shown) returns the switch to the electrically open position, as shown previously in FIG. 14.

It will be noted that this two-way switch performs with the intermediate fabric portion 33 and associated eyelet 111 remaining in the same position irrespective of movement of the cord 137. In an alternative arrangement, the fabric portions 34, 135 and associated eyelets 112, 136 are restrained and movement of the cord 137 causes the intermediate fabric portion 33 and associated eyelet 111 to move with the cord 137. This causes the intermediate eyelet 111 to bear against the eyelet 112 or eyelet 136 as described above, depending on the displacement of the cord. The cord 137 may be rigidly coupled to the eyelet 111. Alternatively the cord 137 may be frictionally coupled to the eyelet 111, for example using a grommet or the like, between the eyelet 111 and cord 137. Such a frictional coupling would allow the cord to slide with respect to the eyelet 111 if the eyelet 111 is already in contact with an eyelet 112 or 136 and an excessive pulling force is applied to the cord. The cord travel can thus exceed the switch eyelet travel. This would serve to prevent damage being induced to the switch due to mishandling and would allow re-centring of the cord in terms of its travel. Importantly, where the cord is implemented in clothing to serve a dual purpose of a tie cord and a switch actuator, the implementation is advantageous as it allows short cord travel for switch operation and greater cord travel for garment tying operations. The grommet may be interposed between the eyelet through-hole 13 of the eyelet 111 and the cord 137. Enlarged portions 138, 139 can be omitted.

The switch may be constructed from the basic components during manufacture of the garment. Alternatively the switch may be manufactured separately as a pre-formed switch device suitable for incorporating in a garment at a later time during garment manufacture. Thus pre-formed switches may be made and sold separately to garment manufacturers.

Figure 17:
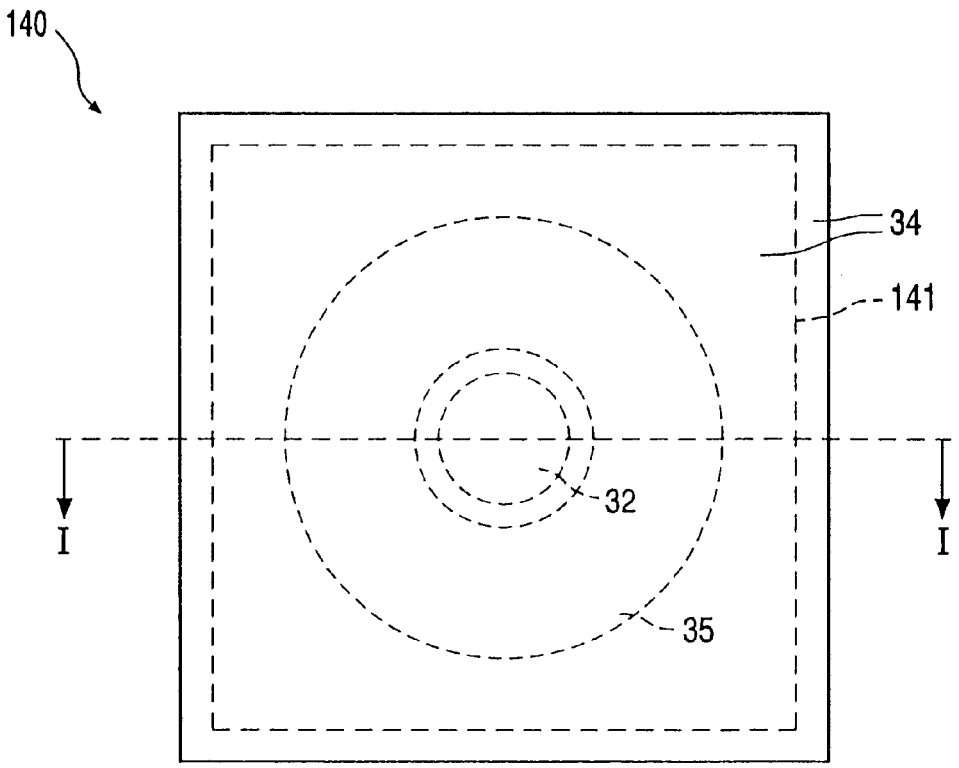
FIG. 17 shows a plan view of a self contained switching device employing one of the switches of FIGS. 1 to 16.
Figure 18:
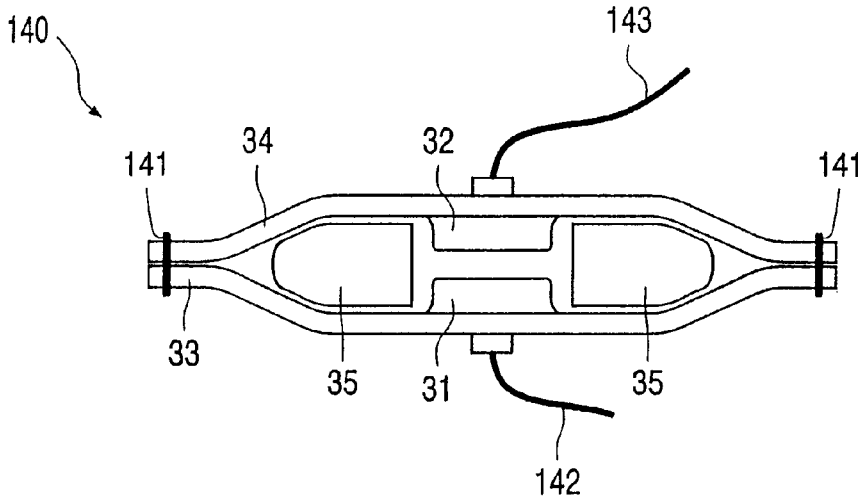
FIG. 18 is a cross sectional view taken along line I—I of FIG. 17.

A pre-formed switch device 140 is shown in FIGS. 17 and 18 which, by way of example only, incorporates the switch 30 described previously. The switch device is held together at seams 141 by stitching, gluing or another suitable fastening method. Connection leads 142 and 143 are provided which have been electrically pre-attached to switch contacts 31 and 32 respectively. Alternatively the connection leads could be replaced by standard terminations such as specified plug or socket types, or even a clothing fastener, accessible on the outside of the switch device. The switch device 140 may be incorporated into a garment simply by attaching the seam region to the garment by stitching, gluing or other suitable fastening techniques. Hence fastening techniques commonly found within the garment construction industry may be employed.

In all of the above described arrangements/embodiments, the switch contacts (whether in the form of eyelets, press fastener halves or other textile fastener device) require that some form of electrical connection is made to them if the device is to be usefully employed as a switch. In those cases where the textile fastener components are mounted on electrically conductive fabric portions, electrical connection is established with the fabric portions automatically as the fastener component is attached. However, in some circumstances, for example when the fabric portions used for mounting the components are not electrically conductive, it is desirable to connect electrical wires or the like to the textile fastener components.

While it is possible to attach wires or the like to fastener components using techniques commonly found in the electronics industry, such as soldering, such techniques involve skills which are not usually found among garment construction workers. Furthermore a technique such as soldering is labour intensive and has the potential of damaging delicate fabrics through the application of heat. Therefore an alternative way of attaching wires to textile fastener components is to introduce the wire to the textile fastening component during the operation of attaching the component to the fabric portion. Where the component is comprised of mating constituent parts, the wire may be introduced between the mating constituents during the operation of attaching those components to the fabric portion. With reference to FIG. 1*a*, examples of mating constituent parts are stud 2*a* with post 2*b* and socket part 6*a* with cap 6*b*, or with reference to FIG. 2*a*, eyelet part 10*a* and washer 10*b*. Where the fastener component is comprised of a single part, such as the eyelet part 10*a* only, the wire can still be introduced during the attachment operation causing it to be gripped by the component.

The components are typically attached to fabric by placing the components in the die of a press, and closing the press to cause portions of one or more component to deform in such a way that components are joined together and/or attached to fabric. For example, with reference to FIG. 1*a* portions 6*c* of the cap 6*b* have been deformed during the attachment operation to bend around and abut the socket part 6*a* as shown. By interposing the wire to be attached between the halves at the time of attachment, the wire is trapped against fastener components and a good electrical connection therewith may be achieved. The wire termination may be connected to the textile fastener component directly or by use of a crimp connector or the like.

One complication of this technique arises through the fact that the dies used in the pressing operation are not designed with the expectation that a wire will be introduced during the attachment operation. The necessary close fit between dies and fastener components required for properly deforming fastener portions during attachment to fabric can result in the wire being damaged or severed by the die when the press is closed. This problem can be overcome by providing a slot in one or more die components of a dimension suitable for accommodating the wire, and optionally the wire and its surrounding insulation, such that during the pressing operation the wire is not severed. A slot can be cut from an outside edge of the die towards the centre. If the die is cast, the slot may be provided during casting. More than one slot may be provided in the die. Slots may be provided in each die component, such that when two die components are brought together on closing the press, the slots of each die component face each other.

The switch of the present invention realises the possibility of a switch suitable for incorporation into garments, and which can be low cost, robust and reliable. The switch can be constructed to be washable without sustaining damage from the washing process. The washing process can included a wet cleaning process, as is widespread in the home environment, or a dry cleaning process.

Figure 3C:
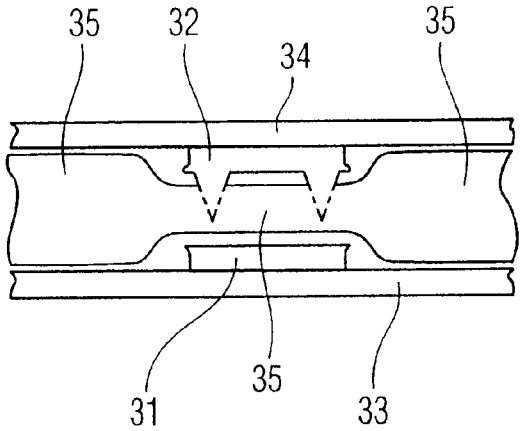

From reading the present specification it will be apparent to the person skilled in the art that other modifications and alternations may be made without departing from the present invention. For example one or more textile fastener component may be provided with protruding spike portions, for example as shown in FIG. 3*c*, directed towards the another textile fastener component and capable of penetrating any material, such as the spacing means, that is interposed between the rings. In this manner application of force to bring the fastener components together brings the spikes of component into contact with the other to form the electrical connection there between. Although the fastener components are said to be electrically conductive, this may be through the applications of a conductive coating, allows the base material of the rings to be electrically conductive or electrically insulating. While the fastener components are said to be mounted on a fabric portion, this may be taken to include any textile material, woven material, needled material, composite material or indeed any natural or man-made sheet like material which would be understood by the person skilled in the art to be capable of performing the function required for the purpose of the present invention. The or each fabric portion may for part of a fabric portion of a garment. The switch may be hidden within a garment or at least partially visible. By employing mating parts of fastener components, such as a stud and fastener part, the switch may be provided with a releasable locking action. The unlocking may be facilitated by attaching a lever to one or the fastener parts. Explicit examples of switches using studs, sockets and eyelets have been given. However, the present invention also includes switches that may employ other textile fastener components such as rivets, burrs posts or the like as will be understood by the person skilled in the art. The switches may be incorporated in garments, soft furnishings or other textile products.

What is claimed is:

1. A switch for use in garments, said switch comprising an arrangement of at least two electrically conductive contact portions arranged in proximity to each other, each contact portion being provided in the form of a textile fastener component mounted on a fabric portion; and resilient spacing means acting to bias the contact portions away from each other such that the contact portions ordinarily reside in a spaced apart relationship, wherein the switch is operable by the application of force directed against the action of said spacing means to move said contact portions towards one another to establish electrical connection there between.

2. A switch in accordance with claim 1 wherein said electrical connection is provided as a result of direct physical contact of the contact portions.

3. A switch in accordance with claim 1 and further comprising a pressure sensitive component arranged in physical and electrical contact with each contact portion, which component undergoes a change in electrical, characteristic as a function of force applied to it, wherein said established electrical connection between the contact portions is provided by the pressure sensitive component while the pressure sensitive component is subjected to the applied force.

4. A switch in accordance with claim 3 wherein said pressure sensitive component includes a polymer material which exhibits a change of electrical resistance as a function of applied force.

5. A switch in accordance with claim 3 wherein the resilient spacing means is provided in the form of the pressure sensitive component.

6. A switch in accordance with claim 4 wherein the resilient spacing means is provided in the form of the pressure sensitive component.

7. A switch in accordance with claim 1 wherein the resilient spacing means is at least partially interposed between the contact portions.

8. A switch in accordance with claim 1 wherein at least one contact portion is provided with protruding spike portions directed towards the other contact portion and arranged to penetrate a material when such material is interposed between the contact portions.

9. The textile fastener component of claim 1 wherein the textile fastener component of one contact portion is of complementary fit with respect to the textile fastener component of the other one contact portion allowing the textile fastener components to be fastened with one another to provide the switch with a latching action.

10. A switch in accordance with claim 1 wherein each textile fastener component is an eyelet arranged to permit a pull cord to pass through each eyelet centre to continue from a first side of the switch through to a second side of the switch, and an abutment arrangement on one of the first or second side of the switch for acting on the one adjacent eyelet and being actuable by the pull cord such that when the pull cord is operated by a pulling action the abutment urges said one adjacent eyelet in the direction of the other to establish the electrical connection.

11. A switch in accordance with claim 1 wherein the textile fastener components are conductive by virtue of a conductive coating material.

12. A garment incorporating the switch of any one or more of claims 1 to 10.

13. A textile article incorporating the switch of any one or more of claims 1 to 10.

* * * * *